United States Patent [19]

Davis et al.

[11] 4,361,240

[45] Nov. 30, 1982

[54] MATERIAL SEPARATING MACHINE

[75] Inventors: William F. Davis, Massillon; Masataka Tsutsumi, Canton, both of Ohio

[73] Assignee: Midwestern Industries, Inc., Massillon, Ohio

[21] Appl. No.: 208,860

[22] Filed: Nov. 21, 1980

[51] Int. Cl.[3] ..... B07B 13/05

[52] U.S. Cl. ..... 209/674; 209/931

[58] Field of Search ..... 209/674, 659, 660, 675, 209/920, 931

[56] References Cited

U.S. PATENT DOCUMENTS 760,590 5/1904 Vodra ..... 209/674 X 3,347,368 10/1967 Mogensen ..... 209/674 X

FOREIGN PATENT DOCUMENTS 76327 9/1970 German Democratic Rep. ..... 209/674

*Primary Examiner*—Allen N. Knowles

*Attorney, Agent, or Firm*—Hamilton, Renner & Kenner

[57] ABSTRACT

A material separating device includes a support member (21) carrying one end of a plurality of rod members (18, 19). The rod members (18, 19) are mounted in a staggered relationship defining two rows which together form separating decks (16, 17). Each rod itself consists of a metallic core (22) and plastic sheath member (25). The diameter of the sheath member (25) determines the distance between adjacent rod members (18, 19).

6 Claims, 4 Drawing Figures

MATERIAL SEPARATING MACHINE

TECHNICAL FIELD

This invention relates to an apparatus for separating a composite material according to the size of the material components. More particularly, this invention relates to an apparatus which performs a scalping or rough separation of materials.

BACKGROUND ART

Rough material separation or scalping is a concept whereby a material, usually a coarse material such as coal or the like, is quickly separated into two or more groups wherein precise sizing is not required. Thus, vibrating screens having a precise mesh are not normally required for such operations. Normally in the past, stationary heavy iron rails positioned in a grate-like fashion have been utilized for such applications. Or, alternatively, the material is passed over a maze of rigid bars with the openings between the bars becoming wider near the discharge end of the machine. However, neither type lend themselves to the efficient separation necessary even for the scalping operation particularly in that the material will tend to stratify thereon with some of the material never coming in contact with the separating bars or rails. In addition, these types of prior art devices are not easily adjustable for different sizing applications.

DISCLOSURE OF THE INVENTION

It is thus a primary object of the present invention to provide a material separating device which efficiently scalps coarse material on a separating deck formed of vibrated rods.

It is another object of the present invention to provide a material separating device, as above, in which the vibrated rods are cantilevered to provide a secondary vibration.

It is a further object of the present invention to provide a material separating device, as above, in which the separating deck consists of two rows of rods, the rods of one row being staggered with respect to the rods of the other row.

It is an additional object of the present invention to provide a material separating device, as above, in which the effective openings between the rods can be changed without totally dismantling the device.

It is yet another object of the present invention to provide a material separating device, as above, in which the rods will not wear nor will sticky material cling thereto.

These and other objects of the present invention, which will become apparent from the description to follow, are accomplished by the means hereinafter described and claimed.

In general, the material separating device includes at least one separating deck which receives the material to be separated and allows a preselected size of the material to pass therethrough. The deck includes at least two rows of rods which are carried, in a cantilever fashion, by a support member. The rods of one of the rows are staggered with respect to the rods of the other row. Additionally, the diameter of the rods can be quickly and easily changed to adjust the effective opening between the rods.

PREFERRED EMBODIMENT FOR CARRYING OUT THE INVENTION

Figure 1:
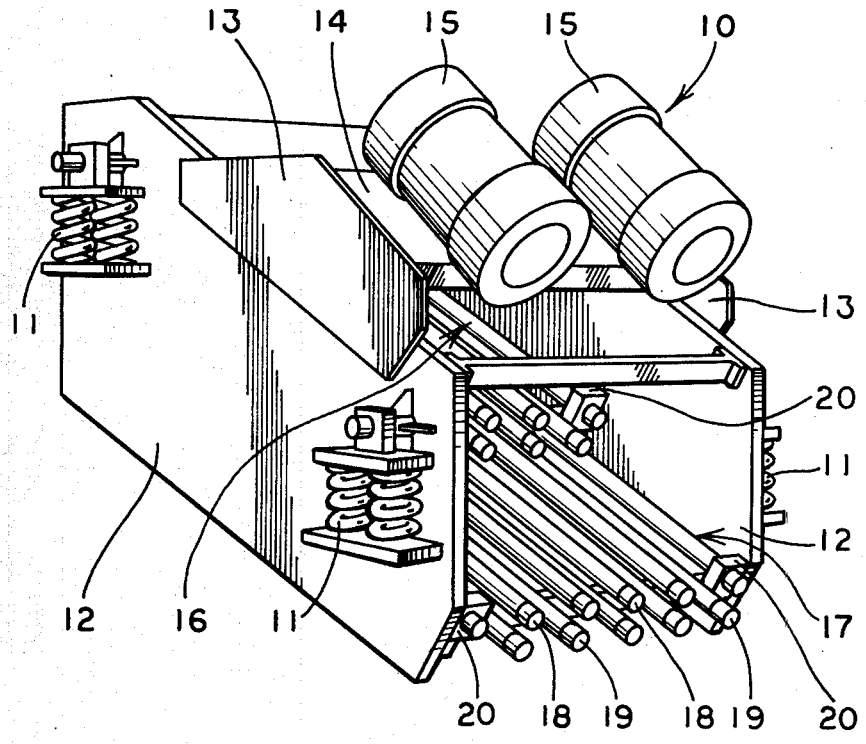
FIG. 1 is a somewhat schematic perspective view of the material separating device according to the concept of the present invention.

A material separator according to the present invention is indicated generally by the numeral 10 in FIG. 1 and is shown as including springs 11 which are supported by a stationary member (not shown). Springs 11 are attached to upstanding vibratory side frames 12. Mounted near the top of each frame 12 are trunnion plates 13 which support a motor mount plate 14 therebetween. While it is possible that the device 10 could be operated without vibration, it is preferable that it be vibrated and to that end, plate 14 carries two vibratory motors 15 which vibrate material separator 10 as carried by springs 11.

Material separator 10 can include any number of separating decks with two such decks being indicated generally by the numerals 16 and 17 and being downwardly inclined from the point at which material is received thereon. Each separating deck includes two rows of rod members, the upper row of rod members being indicated by the numeral 18 and the lower row of rod members being indicated by the numeral 19. As shown in FIG. 1, rod members 18 are staggered from rod members 19 to present somewhat of a zigzag pattern to the material to be separated. As will be described hereinafter in more detail with respect to FIG. 2, the rod members 18 and 19 are supported only at one end with this cantilever mounting providing a secondary vibration to that supplied by motors 15. Although it is not mandatory, it is preferred that the row of rod members 19 be slightly longer than rod members 18. This increases the secondary vibrations in the lower row which because the ends of the rows are vibrating at different amplitudes gives a better separating action. To protect side frames 12 from damage due to the vibration of the rods, each end rod 18 may be fixed at its outer end, as at 20.

Figure 2:
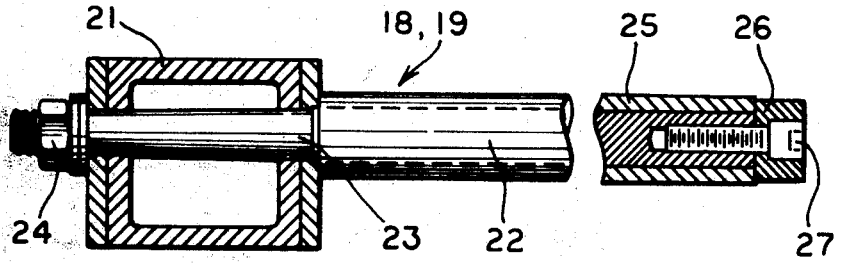
FIG. 2 is a longitudinal sectional view through one of the rods used in the material separating device of FIG. 1.

The configuration and support of a typical rod 18, 19 is shown in FIG. 2. The rods of each row are supported by a support member 21 which extends between side frames 12. The internal core or body portion 22 of each rod is preferably made of a torsion bar steel and includes a Morse taper 23 at the mounting end thereof. Taper portion 23 of the body 22 is received through support 21 and rod 18, 19 is held in place by nut 24. Tightening of nut 24 draws the taper portion 23 tight with support 21 providing a sturdy seating of rod 18, 19 so that the vibrations imparted thereto can be easily withstood.

Figure 3:
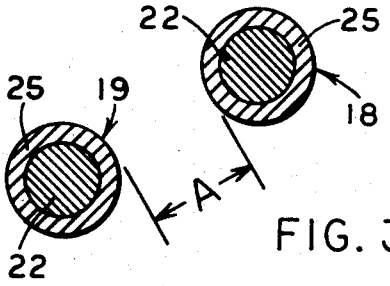
FIG. 3 is a transverse sectional view through two staggered rods of one separating deck showing one size effective opening therebetween.
Figure 4:
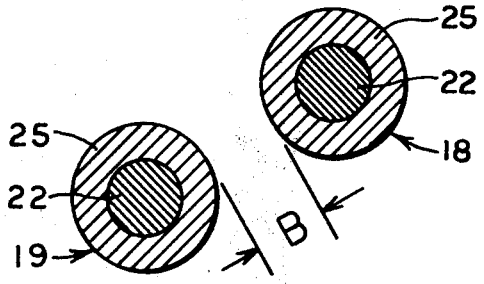
FIG. 4 is a transverse sectional view through two staggered rods of one separating deck showing an effective opening between the rods smaller than that of FIG. 3.

Each rod 18, 19 is provided with a tubular plastic sheath 25 which surrounds the body portion 22 thereof and seats against support member 21. Sheath 25 can be of any durable plastic material, such as polyurethane, and is held in place by an end cap 26 fixed to body portion 22 of rod 18, 19 by a screw 27. Sheath 25 provides many unique advantages in that first, it is wear resistant; second, it resists adhesion to sticky materials; and third, it provides a means by which the spacing between rods 18, 19 can be adjusted without disassembling the whole device. In this latter regard reference is made to FIGS. 3 and 4 which show rods 18 and 19 being provided with two sized sheaths 25. The effective opening A between the staggered rods 18, 19 of FIG. 3 is greater than the effective opening B between the staggered rods 18, 19 of FIG. 4 because of the difference in diameter of the sheaths 25. Thus, by merely removing screw 27 the sheaths 25 may be replaced thereby changing the effective opening between rods 18 and 19 of each deck without disassembling the rod itself from support 21.

In operation material to be separated is fed to upper deck 16 with the material passing therethrough being collected therebelow. Material not passing therethrough, in the two deck embodiment shown, passes to the lower deck for a second separation operation. The various decks can be provided with varying effective openings or can, if desired, have the same effective openings so that the material goes through a double pass process. The cantilevered torsion steel rods accentuate the separation process by providing a magnified secondary vibration to break up any stratification which might otherwise exist.

It should thus be evident that a material separating device constructed in accordance with the invention herein substantially improves the art and otherwise accomplishes the objects of the present invention.

We claim:

1. Apparatus for separating material comprising a support member, first separating deck means receiving the material to be separated thereon and permitting a preselected size of the material to pass therethrough, second separating deck means positioned below said first separating deck means to receive the material not passing through said first separating deck means and permitting said preselected size of the material to pass therethrough, said first and second separating deck means each including at least two rows of rod members, the rod members of one of said rows being staggered with respect to the rod members of the other of said rows within each said separating deck means, all of said rod members being parallel to each other and being carried at one end by said support members, the other end of said rod members being lower than the supported end so that said first and second separating means are downwardly inclined from the point at which the material is received thereon.

2. Apparatus according to claim 1 further comprising means to vibrate said support member.

3. Apparatus according to claim 2 wherein said rows of rod members within each said first and second separating deck means are positioned one above the other, the rod members of the lower of said rows within each said first and second separating deck means being longer than the rod members of the upper of said rows so that the amplitude of the vibrations between the rows is different.

4. Apparatus according to claim 1, said rod members including a metallic rod carried by said support member.

5. Apparatus according to claim 4, said rod members including means to establish the distance between a rod member of said one row to an adjacent rod member in said other row within each said first and second separating deck means, said means to establish including a plastic sheath around said metallic rod.

6. A separating deck according to claim 5 further comprising cap means to hold each said sheath on each said rod.

* * * * *